United States Patent [19]

Wall

[11] 4,334,454

[45] Jun. 15, 1982

[54] GUITAR BRIDGE

[75] Inventor: Rendal Wall, Parchment, Mich.

[73] Assignee: Norlin Industries, Inc., White Plains, N.Y.

[21] Appl. No.: 205,714

[22] Filed: Nov. 10, 1980

[51] Int. Cl.[3] ..... G10D 3/04

[52] U.S. Cl. ..... 84/299; 84/307

[58] Field of Search ..... 84/298, 299, 307

[56] References Cited

U.S. PATENT DOCUMENTS

| | | | |
|---|---|---|---|
| 294,832 | 3/1884 | Wichard . | |
| 490,528 | 1/1893 | Wooster | 84/298 |
| 688,272 | 12/1901 | Truax | 84/298 |
| 727,203 | 5/1903 | Roberts et al. | 84/299 |
| 934,678 | 9/1909 | Laurian | 84/307 |
| 1,889,408 | 11/1932 | Larson . | |
| 2,614,448 | 10/1952 | Maccaferri | 84/298 |
| 3,174,380 | 3/1965 | Cookerly et al. | 84/307 |
| 3,538,233 | 11/1970 | Compton et al. | 84/307 X |
| 3,971,286 | 7/1976 | Borell . | |
| 4,069,733 | 1/1978 | Quan . | |
| 4,128,033 | 12/1978 | Petillo . | |
| 4,135,426 | 1/1979 | Rickard | 84/1.16 |
| 4,175,467 | 11/1979 | Lashley . | |

FOREIGN PATENT DOCUMENTS

| | | | |
|---|---|---|---|
| 2825051 | 12/1978 | Fed. Rep. of Germany | 84/307 |
| 1098375 | 1/1968 | United Kingdom . | |

*Primary Examiner*—Lawrence R. Franklin

*Attorney, Agent, or Firm*—Harness, Dickey & Pierce

[57] ABSTRACT

An adjustable bridge for a stringed musical instrument is positionable at a selected position longitudinally of the strings of the instrument. The bridge is provided with a plurality of individually adjustable saddles which are mounted for movement in a direction longitudinally of the strings. Each saddle is provided with a dual height and composition insert. The bridge is of varying height laterally of the strings to provide for relatively uniform spacing from the instrument body.

20 Claims, 4 Drawing Figures

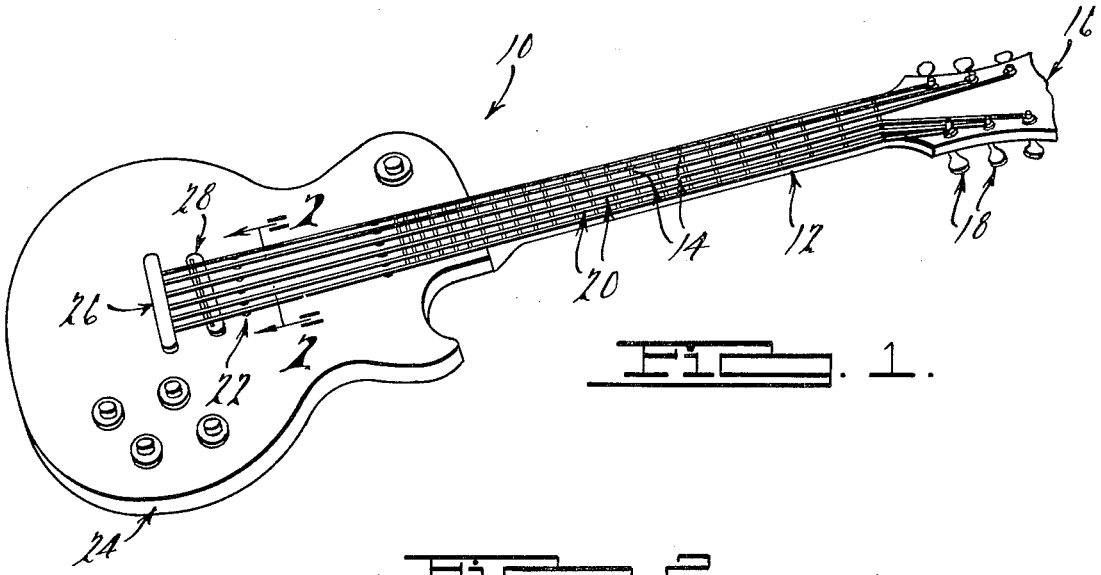
FIG. 1.
FIG. 2.
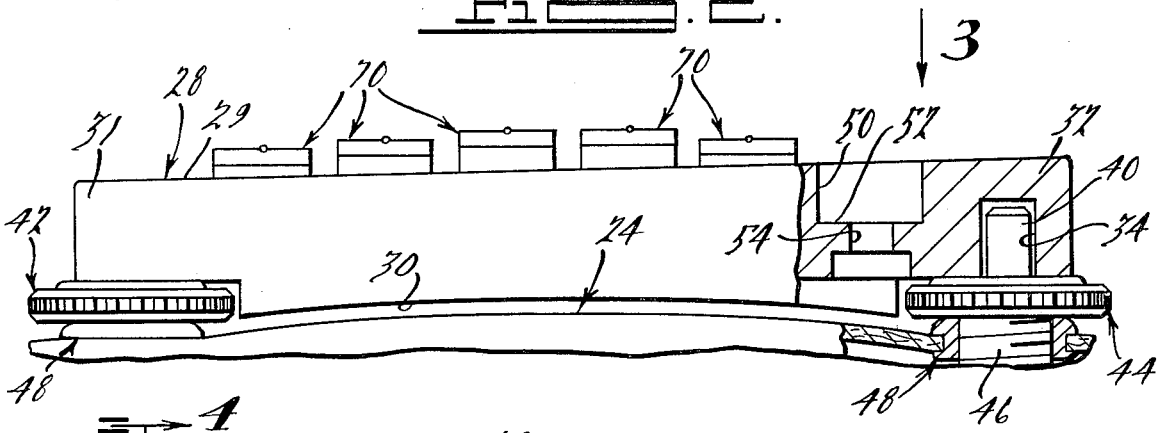
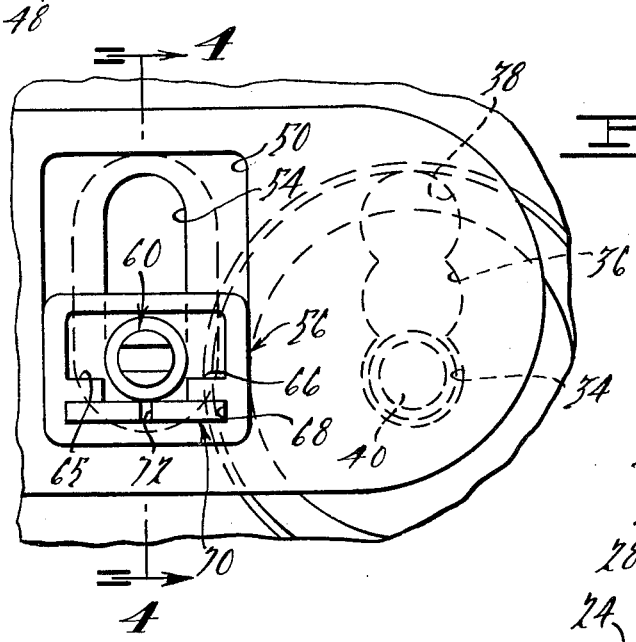
FIG. 3.
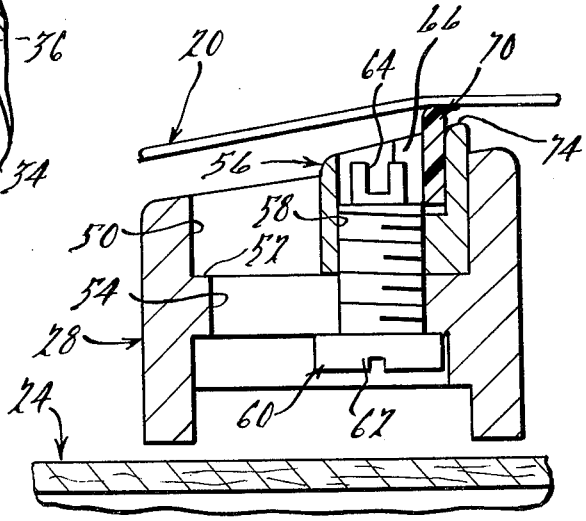
FIG. 4.

GUITAR BRIDGE

BACKGROUND OF THE INVENTION

1. Field of the Invention

The present invention relates to an improved bridge for stringed musical instruments. The bridge is mounted on the body of the instrument to position the tensioned strings thereof which extend between an anchor on the body of the instrument and tuning keys on the head of the instrument. The bridge elevates the strings above the surface of the body and the neck of the instrument and often provides for a plurality of adjustments, in addition to the tuning keys, to control intonation of the strings.

2. Description of the Prior Art

It is known to provide individually adjustable saddles or the like on the bridge of a guitar to provide individual control of intonation of the guitar strings. Such guitar bridges are disclosed in U.S. Pat. Nos. 3,971,286; 4,069,733; 4,128,033 and 4,135,426 wherein it is taught to adjust the height and effective length of the strings to individually control intonation thereof.

SUMMARY OF THE INVENTION

The bridge of the instant invention is adjustably mounted on thumb screws on the upper surface of the instrument. Upwardly extending posts on the thumb screws are engageable in selected pairs of laterally aligned mounting apertures in the bottom surface of the bridge. The bottom surface of the bridge may be maintained in relatively uniform spaced relation to the top surface of the guitar body, variations in string height being achieved by tapering the upper surface of the bridge laterally upwardly. Thus, the knurled portion of the thumb screws are usually disposed at the same height relative to the body of the instrument to insure that loads on the instrument body imposed by the thumb screws are substantially equalized and at like angles to the surface of the body of the instrument.

The bridge is provided with a plurality of saddles that are individually adjustable in a direction longitudinally of the strings to effect individual adjustment of intonation of each string. Each saddle is provided with an insert that elevates the string above a secondary string support surface on the saddle. The saddle insert, which can be either metallic or non-metallic, may be interchanged to achieve different tonal effects, and/or spacing of the strings if desired. In addition, the notching depth of the insert may be varied to achieve special tonal effects.

DESCRIPTION OF THE DRAWINGS

The invention will be apparent from a reference to the accompanying drawings wherein:

FIG. 1 is a perspective view of a guitar equipped with the bridge of the instant invention;

FIG. 2 is a vertical section, partially broken away, taken along line 2—2 of FIG. 1;

FIG. 3 is a view taken in the direction of the arrow 3 of FIG. 2 with a saddle in place; and FIG. 4 is a sectional view taken along the line 4—4 of FIG. 3.

DETAILED DESCRIPTION OF A PREFERRED EMBODIMENT OF THE INVENTION

Referring to FIG. 1, a conventional guitar 10 comprises a neck 12, frets 14, head 16, keys 18, strings 20, pick-up 22, a body 24 and a string anchor 26.

In accordance with the instant invention, the guitar 10 has an adjustable bridge 28. The bridge 28 has a laterally and upwardly tapered upper surface 29 and a lower surface 30 that extends transversely of the strings 20 in relatively uniform spaced relation to the guitar body 24. It should be appreciated, however, that the spacing between the lower surface of the bridge and the guitar body need not be uniform, depending on the action set by the player. The upward taper of the upper surface of the bridge 28 provides primary control of the spacing of the strings 20 from the frets 14 necessitated by variations in string diameter.

The bridge 28 has end portions 31 and 32 with a plurality of longitudinally spaced recesses 34, 36, and 38 therein, (FIG. 3), for the selective acceptance of a stud portion 40 on each of a pair of mounting thumb screws or adjusting thumb nuts 42 and 44. More than one pair of recesses are provided since different string diameters require different mounting configurations for intonation. For example, one set of strings may require use of the recesses 34, while another set of strings, possibly of a different type (including such differences or variations as string diameter, material, winding, manufacturer, etc.), may require the use of recesses 38. It should of course be appreciated that the recesses need not be used in pairs, and an arrangement such as using recess 38 on one side and recess 34 on the other side may be necessary to compensate for the string variations referred to above. The use of a plurality of discrete recesses does away with the need for the complicated holding mechanisms necessary in bridges having continuous slots, and also allows the bridge to be narrower, which is attractive for design purposes.

Rotation of the thumb screws 42 and 44 effects elevation of the bridge 28 thereby to control spacing of the strings 20 from the frets 14. The thumb screws 42 and 44 have threaded portions 46 that are engaged in complementary bushings 48 in the body 24 of the guitar 10. The thumb screws 42 and 44 can be manipulated to raise or lower the bridge 28 of the instant invention relative to the body 24 of the instrument to effect secondary control of the spacing of the strings 20 from the frets 14. The thumb screws 42 and 44 are identical in construction, attachment of the thumb screw 44 to the body 24 being illustrated.

As best seen in FIG. 4, the bridge 28 is provided with a plurality of discrete recesses, one of which is illustrated and designated by the numeral 50. Each recess 50 has a saddle seat 52 with a longitudinal slot 54 therein for the acceptance and seating of a string saddle 56. Adjustment of the strings is simplified if all saddles face in the same direction. Each string saddle 56 has a threaded aperture 58 therein for the acceptance of a complementary screw 60 that is slidably received in the slot 54. The screw 60 has a slotted head portion 62 at one end and a screwdriver slot 64 at the other end to permit adjustment of the position of the saddle 56 from the top of the bridge 28. This allows for relatively simple adjustment from a point behind the focal point on the bridge. Of course, the screw 60 may also be positioned so as to be adjustable from the side or at an angle.

Each saddle 56 has a pair of vertically extending shoulders 65 and 66 defining a slot 68 for the acceptance of an insert 70, made from, for example, Nylon. The insert 70 is provided with a notch 72 for the acceptance and positioning of a guitar string 20. Various materials such as wood, plastic, non-metallic, or metal inserts may be used to achieve different tonal effects.

Intonation of the strings 20 can be initially adjusted by locating the pins 40 of the thumb screws 42 and 44 in the center recess 36 of the bridge 28. Thereafter a secondary adjustment of intonation of each string 20 is individually effected by adjustment of each saddle 56 longitudinally of the string 20 by first loosening the screws 60 in the saddle 56 and, thereafter, sliding the saddle 56 within the slot 54 in the bridge 28. The saddle 56 is then positively locked within the bridge 28 by tightening of the screw 60 with a screwdriver placed in the slot 64 therein.

Use of a non-metallic insert 70 effects a primary tonal characteristic of the string 20 whereby overtones are attenuated. Deepening of the notch 72 in the insert 70 provides a secondary tonal characteristic whereby a relatively longer sustain period and higher frequency response is achieved through direct impingement of the string 20 on an upwardly extending edge 74 of the saddle 56. Also, indirect or partial impingement of the string 20 on edge 74 during vibration of the string may be used to provide a zither-like effect. Such indirect or partial impingement may be produced by having the string 20 only contact edge 74 during vibration, rather than the direct impingement described above. Of course, the notch 72 would have to be adjusted accordingly. Thus, a musician has primary and secondary control of tone as well as primary and secondary control of the fundamental frequency of the string 20. In addition, the tapered configuration of the bridge 28 provides a primary or "built in" accommodation of string diameter variations while the thumb screws provide a secondary adjustment of said spacing.

FIG. 4 also illustrates the longitudinally rearwardly slanted upper surfaces of the bridge 28 and saddle 56 of the present invention. These slants, which provide a lower edge on the anchor-side of the bridge and saddle, allow for string clearance from the focal point on the saddle to the point of attachment to the anchor 26. They also provide maximum down-pressure on the anchor-side of the saddle.

In addition to the advantages described above, the guitar bridge of the present invention is also easily adaptable to different guitar designs and body configurations and of course may be readily adapted for use on a bass guitar where only four string saddles would be necessary. Once the spacing, height, and intonation adjustments are made on the bridge of the present invention, a solid, strong and non-vibrating bridge is provided which allows maximum sustain and improved overall tonal qualities of the guitar. In addition, the relatively narrow longitudinal width of the bridge is attractive for design and aesthetic purposes, and also allows an electronic pick-up on the guitar to be moved closer to the bridge, which results in better amplification of higher frequencies.

It is understood that the foregoing description is that of the preferred embodiment of the invention and that various changes and modifications may be made thereto without departing from the spirit and scope of the invention, as defined in the appended claims.

What is claimed is:

1. An improved guitar bridge adapted to extend laterally under the longitudinally extending strings of a guitar for the support thereof, said bridge having a plurality of longitudinally spaced mounting apertures on opposite ends thereof for effecting primary control of the fundamental frequency of said guitar strings, said bridge also having a plurality of individual secondary control means for adjusting the frequency of each of said guitar strings, whereby said longitudinally spaced mounting apertures provide a plurality of ranges over which said secondary control means may be used for said adjusting of the frequency of each of said guitar strings.

2. A guitar bridge in accordance with claim 1 wherein said bridge has three of said longitudinally spaced mounting apertures on opposite ends thereof.

3. A guitar bridge in accordance with claim 1 wherein said bridge is of a tapered configuration to effect relatively uniform spacing thereof from the body of the guitar yet effect a variation in the height of the central axis of said strings from the body of the guitar.

4. A guitar bridge in accordance with claim 1 wherein said secondary control means includes a plurality of string saddle seats, a plurality of longitudinally movable string saddles in said seats, and screw means adjustable to effect locking of said saddles in said seats.

5. A guitar bridge in accordance with claim 4 wherein said screw means are adjustable from the top of the string saddles.

6. A guitar bridge in accordance with claim 5 wherein each of said string saddles has an insert therein to permit positioning of the associated string at more than one height.

7. A guitar bridge in accordance with claim 6 wherein said insert is plastic to effect attenuation of overtones.

8. A guitar bridge in accordance with claim 6 wherein said insert is notched to preclude lateral movement of said string.

9. A guitar bridge in accordance with claim 8 wherein said insert is notched to allow direct contact between the string and an edge on the associated string saddle.

10. A guitar bridge in accordance with claim 8 wherein said insert is notched to allow indirect contact between the string and an edge on the associated string saddle during vibration of the string.

11. A guitar bridge in accordance with claim 4 wherein the upper surfaces of said bridge and said string saddles are slanted rearwardly toward a string anchor on the guitar.

12. An improved guitar bridge adapted to extend laterally under the longitudinally extending strings of a guitar for the support thereof, said bridge having a plurality of string saddle seats, a plurality of longitudinally movable string saddles in said seats, screw means associated with each of said string saddles adjustable to effect locking of said saddles in said seats, and an insert associated with each of said string saddles to permit positioning of the associated string at more than one height.

13. A guitar bridge in accordance with claim 12 wherein said screw means are adjustable from the top of the string saddles.

14. A guitar bridge in accordance with claim 12 wherein said insert is plastic to effect attenuation of overtones.

15. A guitar bridge in accordance with claim 12 wherein said insert is metal.

16. A guitar bridge in accordance with claim 12 wherein said insert is notched to preclude lateral movement of said string.

17. A guitar bridge in accordance with claim 16 wherein said insert is notched to allow direct contact between the string and an edge on the associated string saddle.

18. A guitar bridge in accordance with claim 16 wherein said insert is notched to allow indirect contact between the string and an edge on the associated string saddle during vibration of the string.

19. A guitar bridge in accordance with claim 12 wherein said bridge also has bridge adjustment means for adjusting the position of said bridge relative to said guitar, thereby altering the position of said string saddle seats relative to said guitar.

20. A guitar bridge in accordance with claim 19 wherein said bridge adjustment means comprises a plurality of longitudinally spaced mounting apertures on opposite ends of said bridge.

* * * * *